United States Patent [19]

Meyer

[11] Patent Number: 4,756,096

[45] Date of Patent: Jul. 12, 1988

[54] FOOTWEAR INSOLE

[76] Inventor: Grant C. Meyer, 3896 Highgate Rd., Muskegon, Mich. 49441

[21] Appl. No.: 930,521

[22] Filed: Nov. 14, 1986

Related U.S. Application Data

[62] Division of Ser. No. 803,082, Nov. 27, 1985.

[51] Int. Cl.[4] ..... A43B 13/40; A43B 13/38

[52] U.S. Cl. ..... 36/44; 36/43; 36/88; 12/142 N

[58] Field of Search ..... 36/43, 44, 88, 93; 128/595, 622; 12/142 N

[56] References Cited

U.S. PATENT DOCUMENTS

| | | | |
|---|---|---|---|
| 1,914,049 | 6/1933 | Smith | 264/223 |
| 2,565,758 | 8/1951 | Covino | 264/223 |
| 2,688,760 | 9/1954 | Forte | 12/146 |
| 2,760,281 | 8/1956 | Cosin | 128/595 |
| 2,917,782 | 12/1959 | Goldwag | 264/223 |
| 3,239,952 | 3/1966 | Lange et al. | 36/2.5 |
| 3,320,347 | 5/1967 | Greenwalt | 128/595 |
| 3,333,353 | 8/1967 | Garcia | 36/68 |
| 3,398,221 | 8/1968 | Sherman et al. | 264/223 |
| 3,530,595 | 9/1970 | Vogel | 36/2.5 |
| 3,825,017 | 7/1974 | Scrima | 36/44 |
| 3,858,337 | 1/1975 | Vogel | 36/55 |
| 3,895,405 | 7/1975 | Edwards | 36/88 |
| 3,995,002 | 11/1976 | Brown | 12/142 |
| 4,503,576 | 3/1985 | Brown | 36/43 |
| 4,550,461 | 11/1985 | Dennis et al. | 12/146 |

FOREIGN PATENT DOCUMENTS

| | | | |
|---|---|---|---|
| 1168440 | 6/1984 | Canada | 36/43 |
| 3405964 | 1/1985 | Fed. Rep. of Germany | 36/43 |

OTHER PUBLICATIONS

"Peterson Laboratories Wants You to Ski Your Level Best" brochure, P.O. Box 788, Lake Placid, New York 12946, copyright 1982.

$R_x$ and the Skier, Ski Magazine, Dec., 1978.

"If the Boot Fits . . . Your Probably Have a Custom Insole", Ski Magazine, Dr. Jeffrey Ross & Steve Cohen, Oct., 1984.

"Orthotics", Sven Coomer.

Impression Foam System, Smithers Bio-Medical Systems brochure, P.O. Box 118, Kent, Ohio 44240.

The Biotech Custom Insole Machines brochure.

The Peterson System, Peterson Laboratories, P.O. Box 788, 331 Main Street, Lake Placid, New York 12946.

Powder, "Tuning Up Boots", Tim Petrick, Oct., 1985.

Superfeet Inshoe Systems catalog, Superfeet In-Shoe Systems Inc., P.O. Box 186, Custer, Washington 98240, copyright 1985.

"Construction of the Quickie Sandal", Dec., 1972.

*Primary Examiner*—Steven N. Meyers

*Attorney, Agent, or Firm*—Price, Heneveld, Cooper, DeWitt & Litton

[57] ABSTRACT

A custom molded insole for supporting the human foot in a ski boot or other footwear is disclosed. The insole is a one-piece, thin, contoured blank of semi-rigid, bendable, resilient material molded to include the complete detail of the full plantar surface of a foot. The insole provides a four-point contact with a supporting surface or ski boot at the heel, great toe, and at least two spaced metatarsal heads to provide natural balance and proper dynamic positioning of the foot and immediate energy transfer between the foot and various footwear such as a boot/ski when skiing.

Also disclosed is the method for making the custom insole including forming a negative impression of the plantar surface in an impression retaining material by pressing the foot into the material while bearing at least a portion of the body weight on that foot with the impression material firmly supported on a rigid surface. A heated blank of the resilient material is then formed in the impression, preferably using the same foot to press the blank down into the impression.

Also disclosed is a kit for forming the custom insole including at least one piece of impression material and at least one blank of semi-rigid, bendable, resilient material.

25 Claims, 4 Drawing Sheets

FOOTWEAR INSOLE

This is a division of Ser. No. 06/803,082, filed Nov. 27, 1985.

BACKGROUND OF THE INVENTION

This invention relates to insoles for footwear and, more particularly, to a custom molded insole for ski boots or other footwear, as well as a process and kit of materials for making such insoles.

Because the human foot differs from person to person, footwear is typically mass produced to fit a range of feet including various differences and abnormalities. Hence, such footwear does not properly accommodate all feet. Problems with proper fit are greater with more rigid footwear such as ski boots. Such problems include looseness or sloppiness resulting in poor ski control due to movement of the foot within the ski boot, as well as rubbing, chafing and foot fatigue. In order to overcome such an improper fit and reduced ski control, many persons compensate by overtightening ski boots to prevent undue foot movement. Overtightening cuts off circulation in the foot causing the foot to become cold, sore or otherwise totally uncomfortable.

Numerous types of insoles and orthotic appliances fitted to the foot have been proposed to overcome the above problems. In addition to attempting correction of improper fit, many such devices attempt to correct foot/leg/knee alignment to a perceived "norm" such that the fitted insoles or orthotic devices hold the foot and leg in a "corrected" position.

Two theories of fitting such insoles and devices have typically been followed. A first theory advocates fitting or molding of an insole material to the foot when the foot is in a non-weight bearing condition, i.e., when a person is sitting and the foot is suspended. Such insoles require the taking of an impression of the foot bottom, the preparation of a positive replica of the foot from such an impression and the forming of an insole from that positive. Alternately, an insole material is cast or molded directly to the foot with a vacuum enclosure or the like while the person is sitting. In all of these methods, the resulting insoles tend to support the foot in a non-natural position which is different from the foot position which results when weight is placed on the foot. Accordingly, it is believed that such devices do not provide all the advantages or correction for which they have been promoted.

A second theory advocates the forming of insoles while a person bears weight on the foot. It is believed that such insoles come closer to providing the proper foot position and control when used in a ski boot or other footwear. However, known methods of weight bearing insole production have used various types of forming cushions and/or knee/leg alignment devices which either do not produce a natural foot position or produce insufficient detail of the bottom of the foot. In addition, numerous of such prior methods require the artificial buildup of various areas of the molded insole with extra material to accommodate for pressure points on the foot and the like.

The present invention was conceived in recognition of the above problems and shortcomings of prior known insoles or molded orthotic devices for ski boots or other footwear.

SUMMARY OF THE INVENTION

The present invention is a custom molded insole for supporting the foot in a ski boot or other footwear formed in one piece from a blank of semi-rigid, bendable, resilient material to include the exact contour of the plantar surface or sole of the human foot such that the insole will remain in close contact with the entire plantar surface of the foot. The invention also includes a novel method for taking an impression of the foot in weight bearing condition and forming a blank of material to that contour. Finally, the invention includes a kit of materials for practicing the method and forming the custom molded insole.

In one aspect, the invention is a method for forming a custom molded insole which includes the forming of a negative impression of the entire plantar surface/sole of a foot in impression retaining material by pressing the foot into the impression material while bearing at least a portion of one's body weight on the foot with the impression material firmly supported on a rigid surface. The foot is then removed from the impression material and replaced with a blank of formable material which extends over the entirety of the negative impression. The blank is then formed to the contour of the negative impression by pressing the blank into that negative impression, after which the blank is removed from the negative impression to provide the contoured, formed insole.

Preferably, the negative impression is taken in a block of dry, compressible foam by standing over the foam block with one foot on the foam and placing the body weight on the foot being pressed into the foam. Preferably, the knee is flexed during pressing of the foot to create the proper arch impression and make the balance points of the foot more prominent. In addition, the toes are preferably flexed downwardly into the impression material to form distinct toe impressions and a proper toe crest under the toes. Thereafter, the same foot is preferably placed atop the blank when inserted in the negative impression to force the blank into the exact contours of the negative impression and along the bottom of the foot. Further, a heated blank of material is preferably pressed into the impression, followed by cooling to return the contoured blank to a semi-rigid state.

The present method also compensates for various abnormalities in the foot. The method includes posting to add a pad of material under the first metatarsal head when the second or third metatarsal head projects lower than the first metatarsal head such that stable support for the foot is provided. For hypermobile flat feet, the negative impression and contoured insole are formed while holding the toes of the foot raised and in an extended position to create a functional arch of the proper height. For excessively pronated, hypermobile flat feet, the process is performed with the person sitting such that only a portion of the body weight is on the foot.

In another aspect of the invention, a custom molded insole for supporting the foot is provided including a one-piece, thin, formed blank of semi-rigid, bendable resilient material contoured to the plantar surface of a human foot. The blank extends along the full length and width of the foot and includes a plurality of contoured portions corresponding in shape to the various areas of the plantar surface. These include a heel cup, longitudinal arch, transverse arch, relief areas for the metatarsal heads, phalanx grooves and cups, and a toe crest between the metatarsal head relief and phalanx toe groove and cup. These contoured portions form a four-point contact of the insole with a supporting surface such as a ski boot when inserted therein. Such contact stably supports and transfers energy from the foot through the insole to the ski boot or other footwear for precise skiing control.

Preferably, the insole also includes a relief area for the flexor hallicus longus tendon and is formed from thermoplastic material. A preferred material includes a first layer of polyvinylchloride or polyester having a relatively hard surface and a second layer of compressible resilient foam adhered to the first layer such as a closed cell foam formed from a cross-linked combination of polyethylene and sponge.

In yet another aspect of the invention, the custom molded insole is one formed by the process of the present invention.

A further aspect of the invention is the kit for forming the custom molded insole including at least one piece of crushable material for retaining a negative impression of the plantar surface/sole of a foot, and at least one blank of a semi-rigid, bendable, resilient material which is formable and pliable when heated. The blank approximates the size of a foot and is adapted for insertion into the negative impression in the crushable material to form the contour of the impression.

The insole of the present invention provides significant advantages over prior known insoles and orthotic devices designed for sports activities such as skiing. The insole not only increases comfort and circulation in the foot for greater warmth, but promotes a feeling of "grasp" which simulates toe flexion and extension due to the toe crest and other contoured areas in the insole which allow the wearer to feel the ski's total edge for precise control. The insole prevents foot cramping and fatigue, maintains the integrity of the foot such that it works as a unitary whole, eliminates rubbing and chafing, and provides for immediate energy transfer from the foot to the ski through the ski boot without looseness or sloppiness. The insole also absorbs shocks when skiing on ice or hardpack snow. Pressure points on the plantar surface of the foot are eliminated, as is the need to overtighten buckles in a ski boot for a snug fit.

In addition, the preferred fabrication method includes knee and toe flexion and extension, raises and lowers the foot arch to create the most functional height for the arch, makes the balance points of the foot prominent, creates a midpoint between pronation and supination, creates a proper toe crest as well as relief grooves and cups for the toes and soft tissues, and prominates the metatarsal heads and flexor hallicus longus tendon. As a result, with the range of motion used in the method, the resulting insole supports the foot in its most dynamic position for skiing and natural and proper balance. The method requires less fitting time and labor, requires no expensive fitting machines, can be performed for lower costs, and better accommodates both normal and abnormal feet than prior known methods.

These and other objects, advantages, purposes and features of the invention will become more apparent from a study of the following description taken in conjunction with the drawings.

DESCRIPTION OF THE PREFERRED EMBODIMENTS

Figure 1:
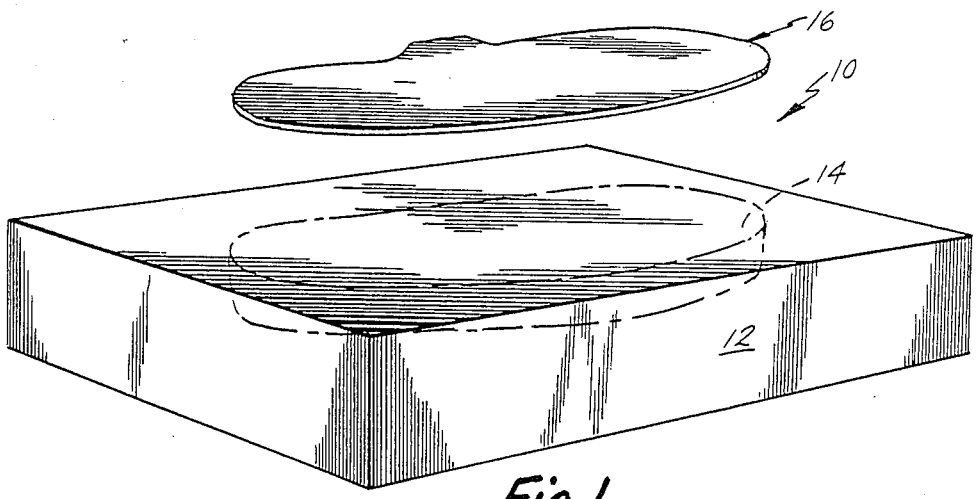
FIG. 1 is a perspective view of the preferred dry foam block for creating the negative impression of the foot and an unformed blank of material for insertion in the negative impression to create the contoured insole of the present invention.
Figure 2:
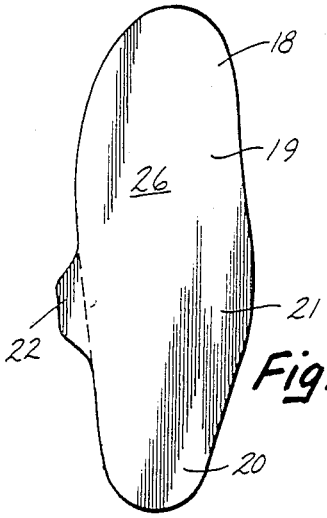
FIG. 2 is a plan view of a preferred form of the unformed insole blank.
Figure 3:
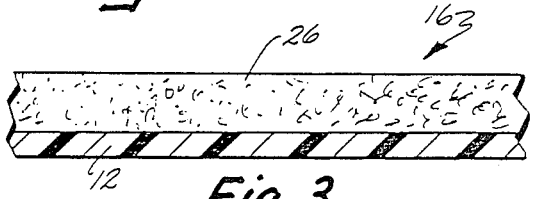
FIG. 3 is a sectional view of the preferred two-layer thermoplastic material from which the insole blank is formed.

Referring now to the drawings in greater detail, FIGS. 1–3 illustrate the preferred kit of materials used for forming the custom molded insole for ski boots or other footwear of the present invention and in the preferred method for forming such insoles. As shown in FIG. 1, kit 10 includes a block of dry, compressible foam material 12 generally rectangular in shape and of a size sufficient to accommodate the entire area of the plantar or bottom surface or sole of a human foot with a bordering margin therearound. As explained below in connection with the method, the foot is placed atop the top surface of the foam block 12 and pressed downwardly into the foam when the foam is supported on a rigid supporting surface to form a negative impression 14 within the foam.

The second component of the kit 10 is a flat, planar blank or pattern 16 of the preferred formable, thermoplastic material. Blank or pattern 16 is slightly larger than the size of the foot plantar surface to be formed and includes a toe area 18, metatarsal area 19, a heel area 20, arch area 21 and a side tab 22. Tab 22 extends laterally outwardly from the outside marginal edge of blank 16 as shown in FIG. 2. Tab 22 is adapted to be trimmed off along the dotted line shown in FIG. 2 after formation of the insole but provides a convenient grasping area for handling and removal of the formed insole from the negative impression 14 after formation and cooling. The tab also helps to align and center the blank in the negative impression.

Typically, kit 10 includes two of the foam blocks 12 positioned side by side in a cardboard container (not shown) which may include protective cardboard housings within the container over the foam blocks. The flat, unformed blanks 16, one for each of the left and right feet and which are mirror images of one another, are placed atop the foam blocks within the container and the package is sold as a unit ready for use. As explained below, kit 10 may also include a quantity of self-adhesive foam material for forming add-on stabilizing pads for attachment to the bottom surface of contoured insole for compensation for irregularities in the foot being molded in the method.

Although the impression retaining material for use as block 12 with the method described below may be any material which retains impression 14 of the foot plantar surface for at least a sufficient time after removal of the foot to enable heating and contouring of the blank to be formed into the insole, the preferred material is crushable for permanent compression under the plantar surface to form negative impression 14 while leaving upstanding walls surrounding the impression as shown in FIG. 1. One material found suitable is a dry, compressible closed cell foam formed from a combination of phenolic resins and sold under the trademark "BIO-FOAM" by Smithers Biomedical Systems of Kent, Ohio. The "BIO-FOAM" material may be obtained in various compression strengths although a standard compression strength which is fully crushable under the weight of a normal human being, either child or adult, is suitable and preferred. Such foam is chemically nonreactive with the human body and has been approved for the intended purpose.

As shown in FIG. 3, a preferred material for blanks or patterns 16 is a multi-layer compilation of semi-rigid, bendable, resilient thermoplastic resinous sheet material such as polyvinylchloride or polyester having a relatively hard, smooth surface which forms the bottom 24 of the custom molded insole. One suitable resinous plastic sheet material is that sold under the trademark "BOLTARON" Type 1 white polyvinylchloride having a preferred thickness of 0.0620 inches and sold by the Diversitec-General Division of General Tire of Newcomerstown, Ohio under Product No. 10011150001. Such material is a semi-rigid plastic sheet which forms well at temperatures obtainable with ovens or heat guns available for use in the present method.

Preferably, bottom resinous plastic layer 24 is adhered to a slightly thicker, resilient, compressible foam layer 26 by a suitable adhesive such as that sold under Product No. 15-273-9907 by Kingco Company of St. Louis, Mo. Foam layer 26 preferably has a thickness of approximately 0.125 inches and is selected to form well when combined with resinous plastic layer 24 at temperatures obtainable with ovens or heat guns as described below. One suitable foam is a closed cell combination of cross-linked polyethylene and sponge sold under the trademark "PELITE" by Durr-Fillauer of Chatanooga, Tenn. "PELITE" foam is a hypoallergenic prosthesis grade foam which is approved by the U.S. Food and Drug Administration for use in human prosthetic devices and which contacts the human body without reaction. Although sufficient to absorb shocks and compress under weight, the foam is sufficiently resilient to return to its original thickness when weight is removed and is sufficiently durable to resist wear during use as an insole.

Alternately, resinous plastic layer 24 may be formed from a polyester material which has slightly more durability and slightly better forming capability than the polyvinylchloride material described above. One such suitable polyester is that sold under the trademark "VIVAC" by Sheffield Plastics Company of Sheffield, Mass. "VIVAC" polyester is preferably used in the same thickness and formed at the same forming temperatures as is the "BOLTARON" polyvinylchloride described above.

Figure 4:
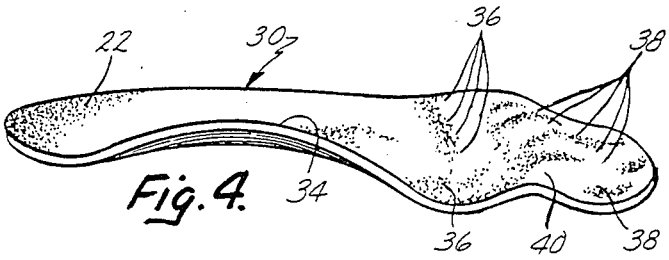
FIG. 4 is a perspective side view of a finished custom molded insole of the present invention formed to the contour of a normal human foot.
Figure 5:
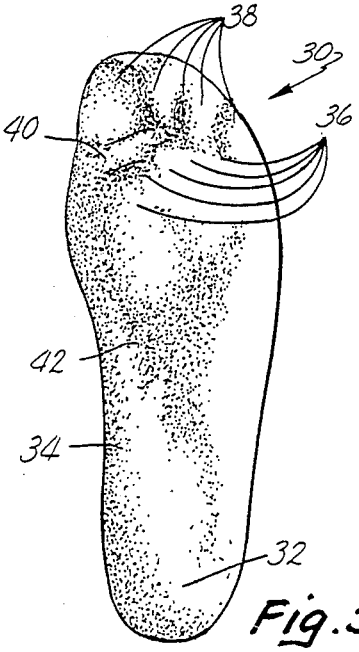
FIG. 5 is a bottom plan view of the custom insole of FIG. 4.
Figure 6:
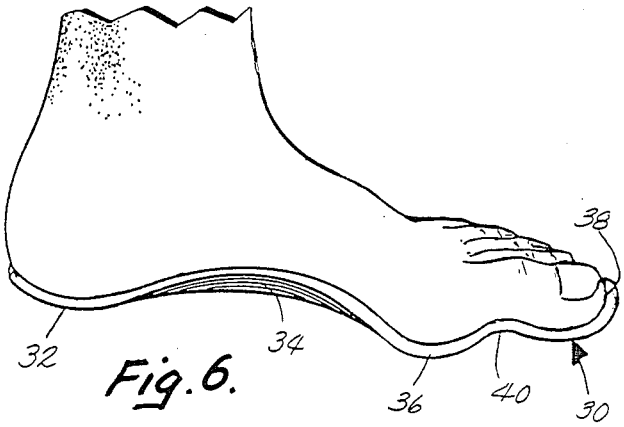
FIG. 6 is a perspective side view of the insole of FIGS. 4 and 5 shown supporting the foot to which it was

Referring now to FIGS. 4–6, custom molded insole 30 of the present invention is adapted to firmly and tightly support the plantar surface/sole of the foot in close contact and corresponding shape and detail within a ski boot or other footwear when substituted for the normal insole as shown in FIG. 6. When formed from the semi-rigid, bendable, resilient thermoplastic material as described above, insole 30 extends along the full length and width of the foot as shown in FIG. 6 but ends at the edge of the foot. It has a plurality of contoured portions which correspond exactly to the shape of the various areas of the plantar surface and which are more detailed than prior known insoles. Such contoured areas include a shallow heel cup 32, a longitudinally and transversely extending arch 34, relief areas for the first (or ball of the foot), second, third, fourth and fifth (outside) metatarsal heads, toe or phalanx grooves and cups 38, and a toe crest 40. Toe crest 40 is formed to the sulcus area on the underside of the foot which extends transversely or across the underside of the foot beneath the proximal interphelangial phalanxes and the interphelangial phalanxes, i.e., under the toes, and surrounds and cups the metatarsal heads. These contoured portions form a four-point contact of the insole with a flat or plantar supporting surface such as the sole area of a ski boot. The four-point contact is provided by heel cup 32, first and fourth or fifth metatarsal head relief areas 36, and great or big toe cup 38. Such contact provides for natural balance and dynamic positioning of the foot during activities such as skiing and proper energy transfer from the foot through the insole to the ski boot and ski for proper and precise skiing control.

In addition, as best seen in FIG. 5, the method produces a relief area 42 for the flexor hallicus longus tendon which extends toward heel cup 32 from the first metatarsal head relief 36. When fitted and contoured to the foot as shown in FIG. 6, the insole creates comfort and warmth, prevents cramping and fatigue, allows the foot to function as an integral unit, eliminates rubbing and chafing, and creates a feeling of grasp by simulating toe flexion and extension due to toe crest 40. In addition, foam layer 26 and the entire insole help to absorb and/or spread shock when skiing on ice or hardpack, while the insole alleviates the need to overtighten buckles in the ski boot for a snug, secure fit. The result is overall greater skier performance and edge control.

Referring now to FIGS. 7–14, a preferred form of the fabrication method for custom insole 30 is shown. The method basically includes the taking of a negative impression for each foot for which an insole will be formed, heating a blank of thermoplastic or other formable material, inserting the heated material in the negative impression and pressing the heated material against the negative impression such that the exact contour is transferred to the heated blank. The blank may then be cooled and removed, trimmed and placed within a ski boot for use.

Figure 7:
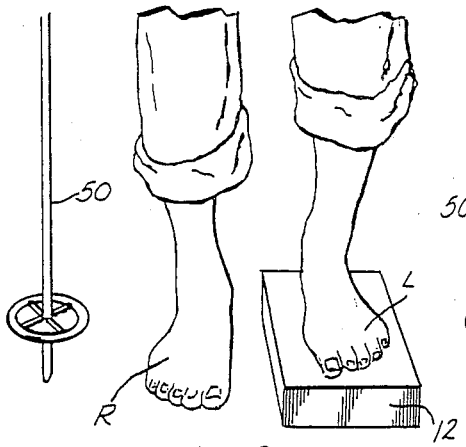
FIG. 7 is a perspective view of the fabrication method showing a foot placed on a block of impression material immediately prior to application of body weight to the foot.
Figure 8:
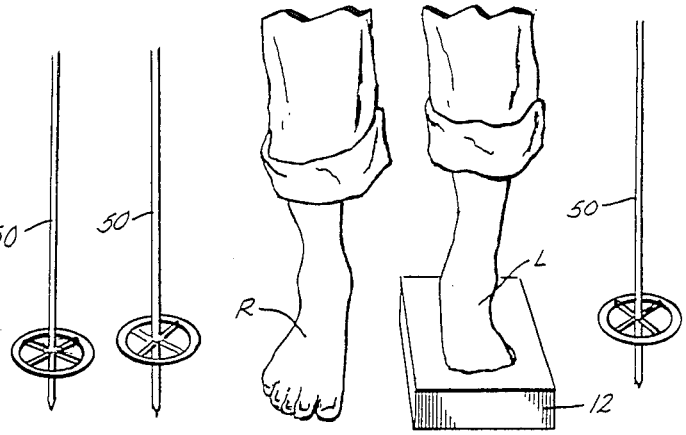
FIG. 8 is a perspective view similar to FIG. 7 but showing the formation of the negative impression after body weight has been applied.

As shown in FIG. 7, a person to be fitted for a custom insole 30 stands over a block 12 of the preferred impression taking foam material with one foot such as right foot R adjacent block 12 with the foot to be formed such as left foot L resting lightly against the top surface of block 12. The left and right feet are preferably parallel while the person and block 12 are both supported on a rigid supporting surface. It is often useful to have the person hold a pair of ski poles such as those shown at 50 for balance and support during the process.

With the knee of foot L to be formed slightly flexed, the person is then directed to gradually shift or transfer his or her weight from right foot R to left foot L until left foot L is fully weighted with the person's body weight. Such movement/transfer presses the foot downwardly through the upper surface of foam block 12 and crushes and compresses the foam beneath the plantar surface of the foot to form negative impression 14 as shown in FIG. 1. The reactive forces from the rigid support surface act through block 12 to resist the pressing action of the foot and create a highly detailed, accurate sole impression.

The person then is directed to flex his or her toes downwardly toward the supporting surface under block 12 which helps form the phalanx or toe relief grooves and cups as well as toe crest 40 in the foam. Next, the person is directed to flex his or her knee from a fully extended position, termed zero degrees, forwardly. Such knee flexion creates an ankle dorsiflextion of between about 15 and 23 degrees. The knee is then returned or extended to the vertical or zero degree position and again forwardly to the flexed position once or twice more to assure a proper impression. This movement should be performed without lateral or side-to-side movement of the foot and recreates the same range of motion that typically exists in a normal ski boot when skiing thereby creating a negative impression of the foot in that normal range of skiing motion. Finally, the person should be directed to extend or raise his toes upwardly (dorsiflexion) and return them downwardly toward the floor or supporting surface under block 12 (planterflexion) while maintaining the knee above that foot slightly flexed.

The above ranges of motion utilized in creating the negative impression in foam block 12 create and detail the exact positions of the foot needed for precise skiing control. Thus, knee flexion which causes ankle dorsiflexion between about zero and 23 degrees and knee extension which causes ankle planterflexion as described raises and lowers the arch of the foot to create the most functional arch height. These motions make the four balance points of the foot mentioned above more prominent in the negative impression. Finally, such movements create pronation which everts the calcaneus bone and abducts the forefoot area (knee flexion) and supination which inverts the calcaneus bone and adducts the forefoot area (knee extension). Similarly, toe flexion and extension creates a more accurate toe crest in the sulcus area between and under the toes and the metatarsal heads, creates the proper relief grooves and cups for the toes or phalanxes, and creates relief areas for soft tissues of the foot. Moreover, toe raising or extension accompanied by knee flexion prominates the metatarsal heads providing accurate relief areas in the negative impression, and prominates or highlights the flexor hallicus longus tendon as described above. Such toe extension also creates supination which inverts the calcaneus and adducts the forefoot. The result is a negative impression as shown in FIG. 9 which will create a custom insole having the proper foot balance points and which maintains the foot in its most dynamic skiing position.

Figure 9:
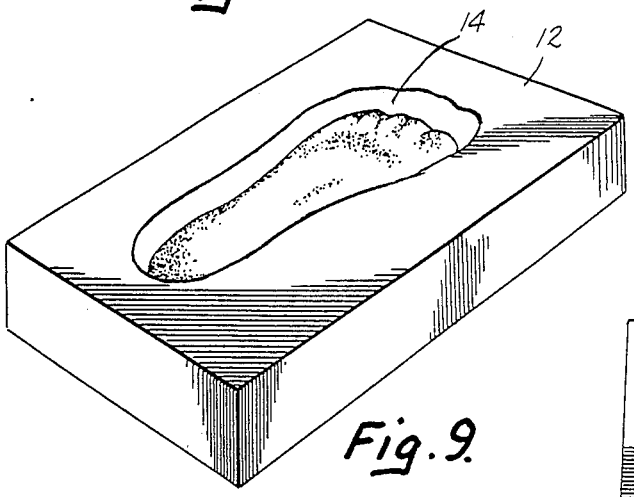
FIG. 9 is a perspective view of the negative impression formed in the preferred dry foam block after the initial step of the method.
Figure 10:
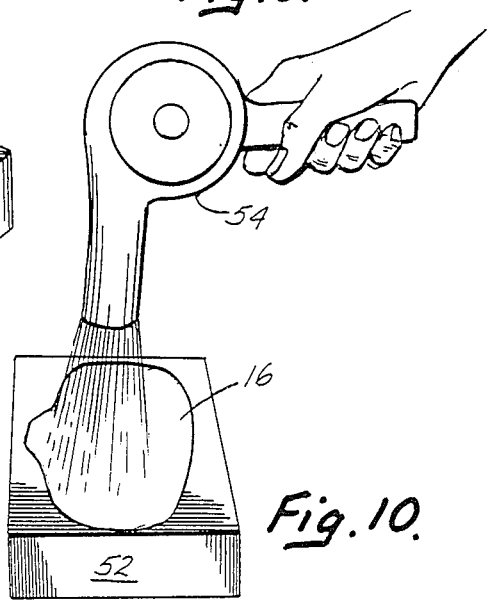
FIG. 10 is a perspective view of the step of heating the preferred thermoplastic blank.

Following formation of the negative impression in block 12 as shown in FIG. 9, the foot is removed from the negative impression 14 and preparations are made for insertion of the heated blank 16 in the impression 14. As shown in FIG. 10, the appropriate pattern or blank 16 for the foot formed in negative impression 14 is laid on a clean, flat surface with its foam layer 26 down and its harder, resinous plastic layer 24 up. Although blank 16 is shown resting on a flat wooden block 52 in FIG. 10, any suitable clean, heat resistant, flat surface could be used. Blank 16 is heated with a conventional heat gun 54 or in an oven until the appropriate forming temperature is reached.

If a heat gun 54 which heats air to a range of between 250 degrees and 500 degrees F. is used, and the preferred combination material PELITE/BOLTARON or PELITE/VIVAC is used in blank 16, the heat gun should be held approximately 3 to 4 inches from blank 16 for approximately 1½ to 2½ minutes while the gun is circulated rapidly to create an even heat throughout the blank. For heat guns which heat air to temperatures between 500 degrees and 750 degrees F., heat should be applied from a distance of 6 to 8 inches from blank 16 also for a time period of between 1½ and 2½ minutes. The precise length of heating will depend upon the room temperature in the area where heating is performed, amount of air conditioning, altitude and the like. Alternately, if an oven such as a convection oven is used to heat blank 16, a temperature in the range of approximately 180 to 250 degrees F. for approximately 2½ minutes depending on altitude and other atmospheric conditions should be used.

Figure 11:
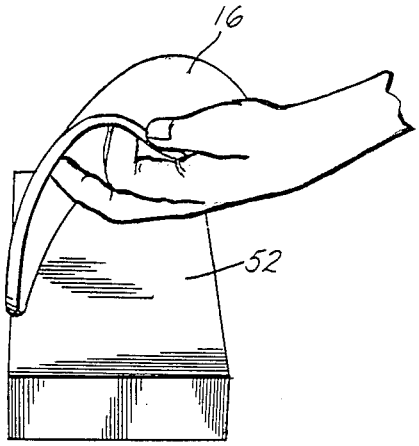
FIG. 11 is a perspective view of the heated thermoplastic blank immediately prior to insertion in the negative impression.
Figure 12:
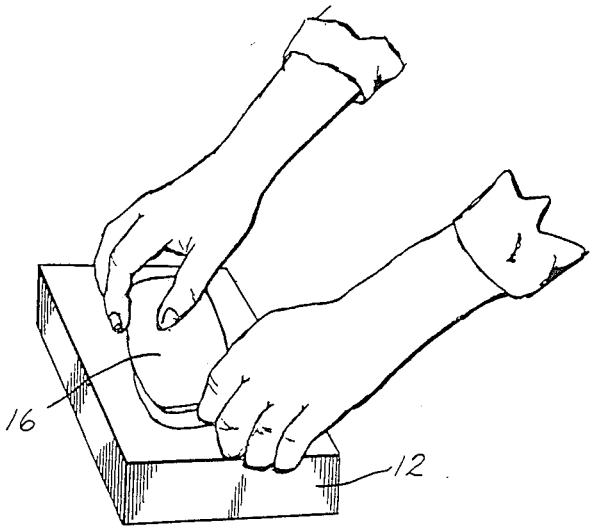
FIG. 12 is a perspective view of the step of inserting the heated thermoplastic blank into the negative impression.

Regardless of the heating method used, blank 16 is ready for forming and contouring when it is totally pliable and flexible and has a consistency like that of a droopy pancake. As shown in FIG. 11, when blank 16 is at such a temperature, it is inserted into the negative impression 14 with its harder resinous plastic surface 24 down and contacting the upper surface of the negative impression as shown in FIG. 12. The heated blank covers the entire extent of the negative impression 14 in block 12. Thereafter, the blank is formed to the contour of the negative impression by pressing the blank into the negative impression.

Preferably, such step is accomplished by placing the same foot of the person used to form the negative impression on top of the heated blank 16 after the bottom of the person's foot is wiped clean since any dirt or particles will be impregnated into the warm foam layer 26 if not removed. The person is then asked to stand over the block 12 containing heated blank 16 and bear weight on the blank with his knee flexed. Thereafter, the steps of knee and toe flexion and extension performed in producing the negative impression 14 in block 12 described above are repeated atop the plastic heated blank to force the heated blank down into the negative impression such that it closely contours to that impression as well as to the bottom of the foot thereover. While performing these motions, any excess material in front of the toes should be pushed down to approximately the same plane as the bottom of the toes on the foot being formed.

Figure 13:
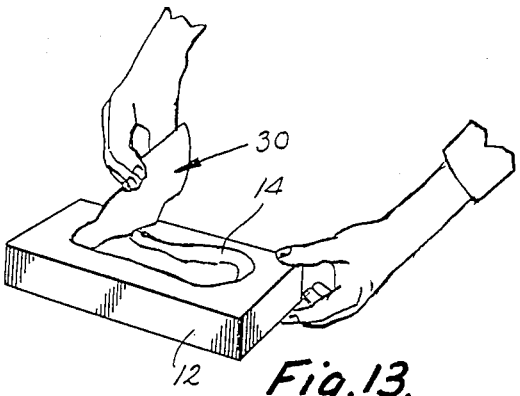
FIG. 13 is a perspective view of the formed insole after cooling during removal from the negative impression.
Figure 14:
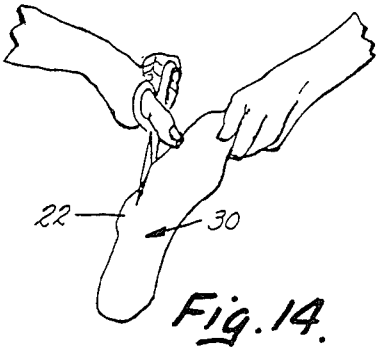
FIG. 14 is a perspective view during trimming of the formed insole to proper size.

After pressing with the foot through the range of motions described above, the foot is removed and the insole is allowed to cool within negative impression 14 for approximately 1 minute at ambient room temperatures. Insole 30, which is now formed and has returned to its generally semi-rigid state, is then removed from impression 14 by pulling upwardly on tab 22 (FIG. 13). Once removed, the insole 30 is allowed to cool completely for at least 2 minutes before any excessive handling. Then tab 22 may be trimmed with conventional scissors (FIG. 14) such that the edge of the formed insole is uniform and will fit well within the intended ski boot or other footwear. In order to properly size the insole for insertion in the intended boot or other footwear, the manufacturer's insole from the boot or footwear is removed and centered on insole 30 while the outline is traced around the manufacturer's insole on insole 30. Thereafter, insole 30 may be trimmed of excess material. It should be noted that the arch area 34 of insole 30 will typically be higher than that of the manufacturer's insole. However, most ski boots and other footwear will accommodate for such condition. As a final step the sides and edges of the insole 30 may be smoothed and refined with a belt sander or the like with any sanded particles being brushed off with a clean towel.

Although the above process has been described for the left foot L shown in the various figures, it should be repeated for the opposite foot R such that insoles will be provided for both feet for proper balance and control.

With reference to FIGS. 15–18, a modified method for accommodating a smaller percentage of persons who bear a majority of their weight toward the outside or middle of their foot is illustrated. This procedure, termed posting, produced a posted insole which overcomes the difficulties such persons have in controlling the inside edges of their skies when skiing, for instance.

Figure 15:
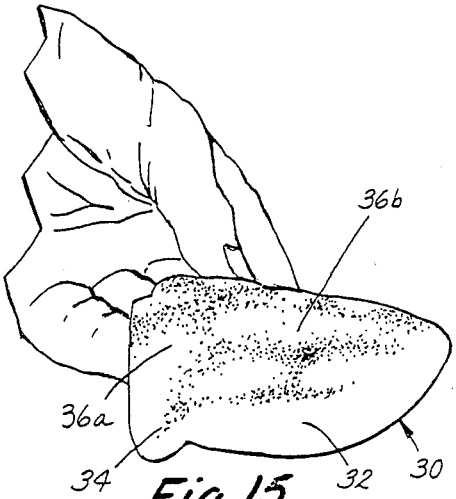
FIG. 15 is a rear perspective view of the bottom of a formed insole of the present invention taken from an average or normal human foot.
Figure 16:
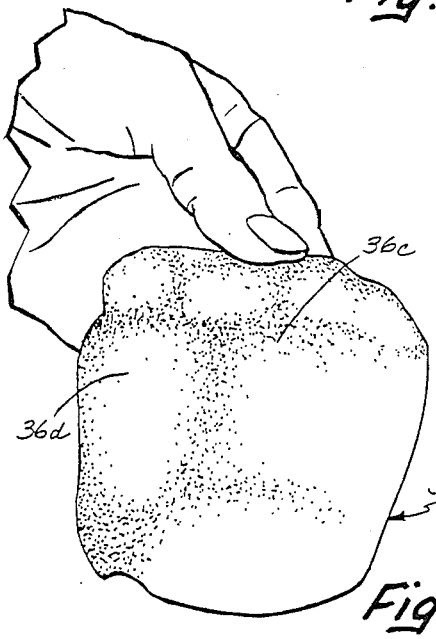
FIG. 16 is a rear perspective view of the bottom of a formed insole of the present invention taken from an abnormal human foot wherein the second and/or third metatarsal heads are more prominent than the first metatarsal head.

As shown in FIGS. 15 and 16, the typical custom molded insole 30 shown in FIGS. 4–6 and fabricated as described above, includes a relief area **36*a* for the first metatarsal head which is at least as high as, or sometimes higher than the relief area for the second or third metatarsal head shown at 36*b*. However, for a smaller percentage of persons, the second or third metatarsal head actually is more prominent and protrudes farther than the first metatarsal head causing a higher second or third metatarsal relief area 36*c* than for the first metatarsal head relief 36*d* in insole 30' in FIG. 16. If uncorrected, such an insole 30' would be unstable when placed on a flat surface and would actually rock or roll from side-to-side because of the pivotal action over the second or third metatarsal head relief area 36*c***.

Figure 17:
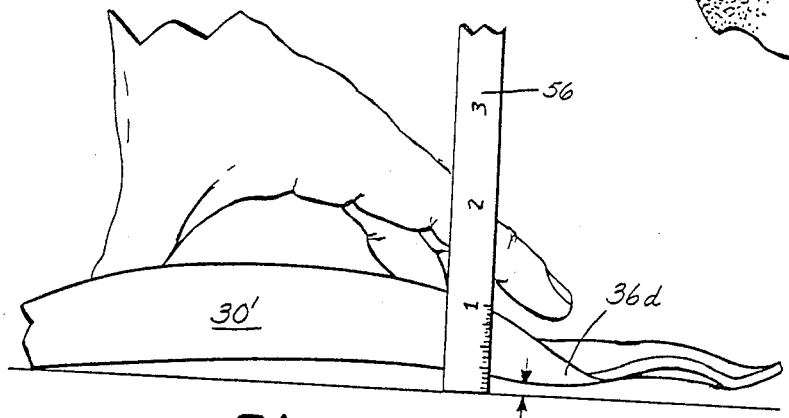
FIG. 17 is a side view of the step of determining the amount of gap to be filled beneath the first metatarsal head during posting of an insole formed like that of FIG. 16.
Figure 18:
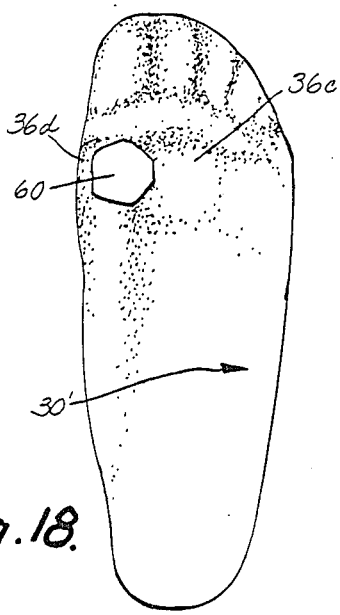
FIG. 18 is a bottom plan view of the custom insole for an abnormal foot of FIG. 16 with a pad of material placed on the surface of the first metatarsal head relief area.

To correct for such unstability, after insole 30' has been formed using the method described above, it is placed on a flat, hard surface with its plastic layer 24 down as shown in FIG. 17. The heel area and most prominent metatarsal relief areas are pressed downwardly against the hard surface while the resulting gap "G" between the first metatarsal head relief area **36*d* and the hard surface is determined or measured such as with a ruler 56. A piece of self-adhesive foam 60 is cut from a piece of such material supplied with kit 10 to approximate the size of the first metatarsal head relief area 36*d* as shown in FIG. 18. The thickness of that foam piece is thereafter sanded such that it approximates the thickness required to fill gap G shown in FIG. 17 and the backing from such foam is removed. Piece 60 is then adhered to the undersurface 36*d* of first metatarsal head relief area to form a stabilizing pad as shown in FIG. 18. When pressure is applied to the insole 30' in the fashion shown in FIG. 17 or by a foot when insole 30' is in use with pad 60, the pad will stabilize the insole and provide for the four-point natural balance contact described above and prevent rocking over second or third metatarsal head 36*c***.

Figure 19:
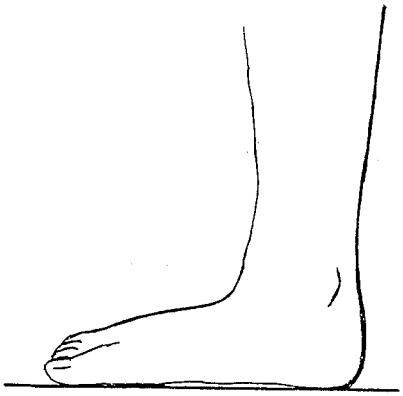
FIG. 19 is a perspective view of a hypermobile flat human foot.
Figure 20:
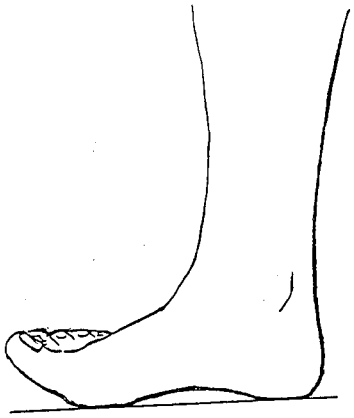
FIG. 20 is a perspective view of the foot of FIG. 19 with the toes raised and extended to create a more natural arch.

Referring now to FIGS. 19–22, a second modified method is illustrated for producing a custom molded insole which accommodates for the hypermobile flat foot. As shown in FIG. 19, the hypermobile flat foot has little or no arch area between the heel and first metatarsal head areas on the inside of the foot. Such a condition can cause early fatigue and difficulty in foot control especially when skiing or participating in other sports activities. To correct for such condition, a more normal arch is created before the negative impression 14 is taken of the foot by directing the person to raise and extend upwardly his toes as shown in FIG. 20. Such movement creates a lifted arch in a more dynamically functional position for skiing.

Figure 21:
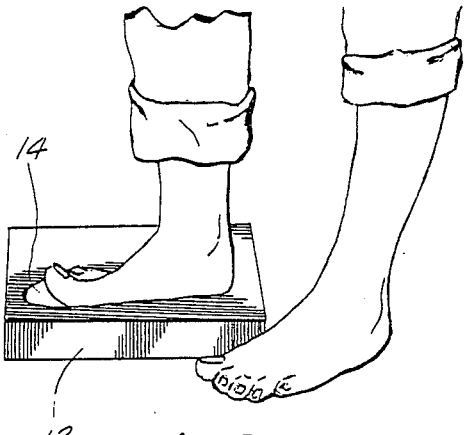
FIG. 21 is a perspective view of the foot shown in FIG. 20 used to form a negative impression with an arch of proper height when the toes are raised and extended.
Figure 22:
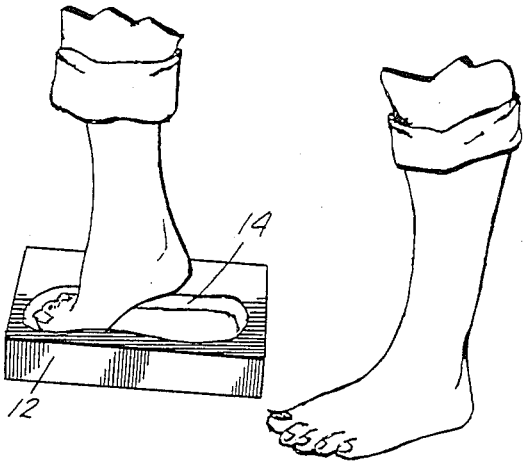
FIG. 22 is a perspective view of the foot of FIG. 20 during formation of the negative impression as rolled forward to create the toe impressions and cups.

The second modified method of forming a custom molded insole includes maintaining the foot with the toes or phalanxes raised and extended while it is being pressed into the top surface of foam block 12 as shown in FIG. 21 while standing. It should be noted that both feet should remain parallel to one another during such process although they are shown at a different position for ease in illustration in FIG. 21. The toes should be maintained in their raised, extended position through weight bearing. Thereafter, as shown in FIG. 22, the person should be directed to lift his or her heel followed by rolling the body weight forward onto the forefoot area of the foot while maintaining the toes in the extended, raised position. The foot may then be removed from the foam block with the negative impression having created therein a more natural arch because of the maintenance of the toes as described. During fabrication and forming of the heated blank 16 in such a negative impression, the person should be directed to place his foot on top of the heated blank while maintaining the toes in their raised, extended position followed by lifting the heel and rolling the weight forward onto the forefoot area just as was done during the formation of the negative impression in the foam block. Such procedure will assure maintenance of the dynamically functional, lifted arch in the foot for correction of the hypermobile flat foot condition.

Alternately, for an excessively pronated hypermobile flat foot, the pressing of the foot into the foam block 12 with the toes in their raised, extended position can be performed while the person is sitting down and is bearing only partial weight on the foot to be formed. The toes are retained in their raised position and the person simply pushes his or her foot into the foam block 12 which is resting on a rigid surface under the foot. Thereafter, the heel is raised while the person remains seated followed by pushing the toes downwardly into the foam. Raising the heel before pushing the toes down prevents destruction of the raised, natural arch area in the negative impression in the foam which otherwise would occur with this type, excessively pronated flat foot. After the impression is created, the same foot movements are used atop the heated blank to form it, all while the person is seated. Such procedure more properly corrects the position of the excessively pronated foot to the dynamically functional, lifted arch position.

Also, it is possible to use a combiantion of the above described methods to fit and accommodate various feet.

The custom molded insoles formed by the methods described above are thereafter preferably substituted for the liner or manufacturer's insole in the boot or other footwear provided. The combined boot and custom insole may then be worn with resulting improved balance and energy transfer. If necessary to correct for discomfort in any particular area, the custom insole may be reheated for slight modifications if desired.

Accordingly, the invention provides a custom insole for normal and other feet which require correction, a fabrication method for such various insoles, and a kit of materials needed for use in the fabrication process with all of the attendant advantages and features noted above.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are defined as follows:

1. A custom molded insole for supporting the foot in a ski boot or other footwear comprising a thin, formed blank of semi-rigid, bendable, resilient material molded to the contour of the plantar surface/sole of a human foot, said formed blank extending along the full length and width of the foot and having a plurality of contoured portions on both its upper and lower surfaces closely corresponding to the shape of various areas of the plantar surface/sole of the foot including a heel cup, longitudinal arch, transverse arch, relief areas for the metatarsal heads, phalanx grooves and cups and a toe crest between the metatarsal head relief areas and phalanx toe grooves and cups; and contoured portions on said lower insole surface forming a four-point contact of said insole with a flat surface beneath at least said heel cup, the first metatarsal head relief area, at least one of said fourth and fifth metatarsal head relief areas and the great toe cup whereby the foot is firmly and stably supported by said four-point contact and forces are immediately and precisely transferred from the foot, through the molded insole to the boot or footwear when the insole is mounted therein.

2. The insole of claim 1 wherein said blank material is a thermoplastic material which becomes formable and pliable when heated and returns to its semi-rigid, resilient condition when cooled.

3. The insole of claim 1 including a relief area for the flexor hallicus longus tendon which extends toward said heel cup from said first metatarsal head relief area.

4. The insole of claim 3 wherein said blank includes a first layer of semi-rigid, bendable resinous material having a relatively hard surface and a second layer of resilient, compressible foam adhered to said first layer; said first and second layers each extending along the full length of the sole of the foot from heel to toe and being tightly adhered to one another along said entire length.

5. The insole of claim 4 wherein said first layer is selected from polyvinylchloride and polyester and said second layer is a closed cell foam.

6. The insole of claim 1 including a pad secured to the surface of said insole beneath said first metatarsal head relief area to compensate for any gap between that relief and a supporting surface due to unusual protrusion of the second or another metatarsal head relief beyond the level of said first metatarsal head relief.

7. A custom molded insole for supporting the foot in footwear, said insole having a plurality of contoured areas on both its upper and lower surfaces corresponding to the shape of various areas of the plantar surface/sole of the foot to provide improved support and stability for the foot in footwear for improved force transmission through the insole to the footwear from the foot, said insole being manufactured from a blank of material by the process of molding the blank to the contour of the plantar surface/sole of a human foot including the steps of:

forming a negative impression of the entire plantar surface/sole of a foot in impression-retaining material by pressing the foot into the impression material while bearing at least a portion of one's body weight on that foot with the impression material firmly supported on a surface;

removing the foot from the impression material and placing an unformed blank of formable material which is formable when heated but retains a desired shape when cooled and which has been heated until it is in a formable condition over said previously formed negative impression in the impression material;

forming the heated blank by placing the same foot used to make the negative impression onto the heated blank, pressing that foot against the heated blank and into the previously formed negative impression of the same impression material with the impression material supported on a surface such that the heated blank is firmly and tightly pressed against the various contours of the previously formed negative impression; and allowing the blank to cool to retain its formed shape and removing the formed blank from the negative impression; said lower surface of said insole having a shape after said forming which closely corresponds to the plantar surface/sole of the foot as defined by said preexisting contour of said previously formed negative impression.

8. A custom molded insole for suppporting the foot in footwear, said insole having a plurality of contoured areas on both its upper and lower surfaces corresponding to the shape of various areas of the plantar surface/sole of the foot to provide improved support and stability for the foot in footwear for improved force transmission through the insole to the footwear from the foot, said insole being manufactured from a blank of material by the process of molding the blank to the contour of the plantar surface/sole of a human foot including the steps of:

forming a negative impression of the entire plantar surface/sole of a foot in impression-retaining material by pressing the foot into the impression material while bearing at least a portion of one's body weight on that foot with the impression material being firmly supported on a rigid surface during such forming;

removing the foot from the impression material and placing an unformed blank of semi-rigid material which is formable when heated and which has been heated until it is in a formable condition over the entire extent of said negative impression in the impression material such that it covers the entire area of said negative impression;

forming the heated blank to the preexisting contour of the previously formed negative impression in the same impression material by placing the same foot used to make the negative impression onto the heated blank, and pressing that foot against the heated blank and into the previously formed negative impression of the same impression material with the impression material firmly supported on a surface such that the heated blank is firmly and tightly pressed against the various contours of the previously formed negative impression; and allowing the blank to cool to return to a semi-rigid state and removing the formed blank from the negative impression; said lower surface of said insole having a shape after said forming which closely corresponds to said plantar surface/sole of the foot as defined by said preexisting contour of said previously formed negative impression.

9. The insole of claim 8 wherein forming said negative impression includes pressing the foot into a solid material which retains the impression for at least a predetermined period of time after the foot is removed therefrom.

10. The insole of claim 9 including pressing the foot into a quantity of crushable material which permanently compresses under the plantar surface/sole of the foot to form the negative impression but leaves upstanding walls surround the impression.

11. The insole of claim 10 including pressing the foot into the impression material while keeping the knee which is above that foot slightly flexed during pressing.

12. The insole of claim 11 including flexing the toes of the said foot downwardly toward the surface supporting the impression material and into the impression material to form distinct toe impressions.

13. The insole of claim 12 including flexing said knee forwardly while pressing the foot into the impression material and then flexing backwardly to a slightly flexed position while avoiding any lateral, side-to-side movement of the foot in the material thereby causing dorsiflextion of the ankle below that knee.

14. The insole of claim 8 including heating an unformed blank of material for a predetermined period of time until the blank is pliable and then placing the heated blank on the negative impression.

15. The insole of claim 14 wherein said blank includes a foam layer and a semi-rigid layer of resin selected from polyvinylchloride and polyester, said heating including supporting said blank with said foam side down and blowing heated air against said semi-rigid side.

16. The insole of claim 8 wherein said forming of the blank in the negative impresison includes transferring the body weight to the foot placed on the heated blank while pressing the heated blank firmly and tightly against the various contours of the previously formed negative impression.

17. The insole of claim 16 including flexing the knee above the foot forwardly and backwardly while pressing the foot against the blank while avoiding lateral side-to-side movement of the foot.

18. The insole of claim 17 including flexing the toes of the foot downwardly toward the surface supporting the impression material while pressing the foot against the blank.

19. The insole of claim 8 including posting the formed blank to correct for unusual prominence of weight bearing metatarsal bones in the middle or outside of the plantar surface/sole by laying the formed blank on a flat surface, pressing down on the heel; and outside areas of the formed blank, determining the gap between the flat surface and the underside of the formed blank beneath the first metatarsal head or ball of the foot area and the flat surface, and securing a piece of material having a thickness generally equivalent to said gap to said first metatarsal head area on the underside of said blank whereby the blank will thereafter be stably supported on such a flat surface.

20. The insole of claim 8 wherein the foot adapted to be supported by the molded insole formed by the method is a hypermobile flat foot; said method including correcting for the hypermobile flat foot condition of the foot while forming said negative impression by pressing the hypermobile flat foot into said impression material with the toes fully raised and extended upwardly.

21. The insole of claim 20 wherein said pressing of the hypermobile flat foot includes maintaining the raised, extended toe position while standing and transferring the body weight to the foot being pressed into the impression material.

22. The insole of claim 21 including lifting the heel of the hypermobile flat foot and rolling the body weight onto the front or forefoot area while continuing to maintain the toes of that foot in extended, raised position.

23. The insole of claim 22 wherein the forming of the blank to the contour of the negative impression includes pressing the hypermobile flat foot onto the blank and against the negative impression with the toes of that foot maintained in their raised, extended positions.

24. The insole of claim 23 wherein pressing the hypermobile flat foot onto the blank includes lifting the heel of that foot and rolling the body weight onto the front or forefoot area while continuing to maintain the toes of that foot in extended, raised position.

25. A custom molded insole for supporting the foot in footwear comprising a thin, formed blank of bendable, resilient material molded to the contour of the plantar surface/sole of a human foot, said formed blank extending along the full length and width of the foot and having a layer of semi-rigid thermoplastic material extending from the heel area of said insole toward the toe area of said insole along at least a portion of the length of said insole, said insole having a plurality of contoured portions on both its upper and lower surfaces closely corresponding to the shape of various areas of the plantar surface/sole of the foot including a heel cup, longitudinal arch, transverse arch, relief areas for the metatarsal heads, phalanx grooves and cups and a toe crest between the metatarsal head relief areas and phalanx toe grooves and cups; said contoured portions on said lower insole surface forming a four-point contact of said insole with a flat surface beneath at least said heel cup, the first metatarsal head relief area, at least one of said fourth and fifth metatarsal head relief areas and the great toe cup whereby the foot is firmly and stably supported by said four-point contact and forces are immediately and precisely transferred from the foot, through the molded insole to the footwear when the insole is mounted therein.

* * * * *

UNITED STATES PATENT AND TRADEMARK OFFICE

CERTIFICATE OF CORRECTION

PATENT NO. : 4,756,096

DATED : July 12, 1988

INVENTOR(S) : Grant C. Meyer

It is certified that error appears in the above-identified patent and that said Letters Patent is hereby corrected as shown below:

Column 4, line 16:

After "was" insert --molded;--.

Column 13, line 55, claim 10:

"surround" should be --surrounding--.

Signed and Sealed this

Thirteenth Day of December, 1988

*Attest:*

DONALD J. QUIGG

*Attesting Officer*

*Commissioner of Patents and Trademarks*